US007609137B2

(12) United States Patent
Roesner et al.

(10) Patent No.: US 7,609,137 B2
(45) Date of Patent: Oct. 27, 2009

(54) ELECTRICAL SWITCHGEAR

(75) Inventors: Norbert Roesner, St. Augustin (DE); Karsten Gerving, Bonn (DE); Guenter Baujan, Troisdorf (DE); Klaus Dauer, Koblenz (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/524,068

(22) PCT Filed: Aug. 7, 2003

(86) PCT No.: PCT/EP03/08757

§ 371 (c)(1),
(2), (4) Date: Feb. 9, 2005

(87) PCT Pub. No.: WO2004/023506

PCT Pub. Date: Mar. 18, 2004

(65) Prior Publication Data

US 2005/0270130 A1 Dec. 8, 2005

(30) Foreign Application Priority Data

Aug. 10, 2002 (DE) ..... 102 36 790

(51) Int. Cl.
*H01H 13/04* (2006.01)

(52) U.S. Cl. ..... 335/202; 335/131; 335/132; 200/293; 200/300

(58) Field of Classification Search ..... 335/196, 335/202, 131–132; 200/293, 300
See application file for complete search history.

(56) References Cited

U.S. PATENT DOCUMENTS

| | | | | |
|---|---|---|---|---|
| 4,739,293 | A * | 4/1988 | Hurley et al. | 335/132 |
| 4,951,018 | A * | 8/1990 | Hanson et al. | 335/132 |
| 5,107,396 | A | 4/1992 | Rosen et al. | 361/355 |
| 5,281,937 | A * | 1/1994 | Young | 335/132 |
| 6,781,491 | B2 * | 8/2004 | Whipple et al. | 335/202 |
| 2004/0020678 | A1 | 2/2004 | Gerving | 174/59 |

FOREIGN PATENT DOCUMENTS

| | | |
|---|---|---|
| CN | 1098564 | 2/1995 |
| CN | 1207828 | 2/1999 |
| DE | 100 23 851 | 11/2001 |
| DE | 201 20 504 | 5/2002 |
| EP | 0633 588 | 1/1995 |
| FR | 1 286 699 | 3/1962 |
| FR | 2707429 | 1/1995 |
| FR | 2 742 918 | 6/1997 |
| WO | WO-9722986 | 6/1997 |

OTHER PUBLICATIONS

International Search Report for International Application No. PCT/EP2003/008757, Oct. 2003.

* cited by examiner

*Primary Examiner*—Ramon M Barrera
(74) *Attorney, Agent, or Firm*—Darby & Darby

(57) ABSTRACT

An electrical switching device having at least one pole includes a housing of an insulating material, and an incoming terminal contact and an outgoing terminal contact associated with a first pole. Each of the terminal contacts includes a first connection device for connection of a first external electrical conductor. At least one of the terminal contacts includes a second connection device for pluggable connection of a second electrical conductor.

12 Claims, 4 Drawing Sheets

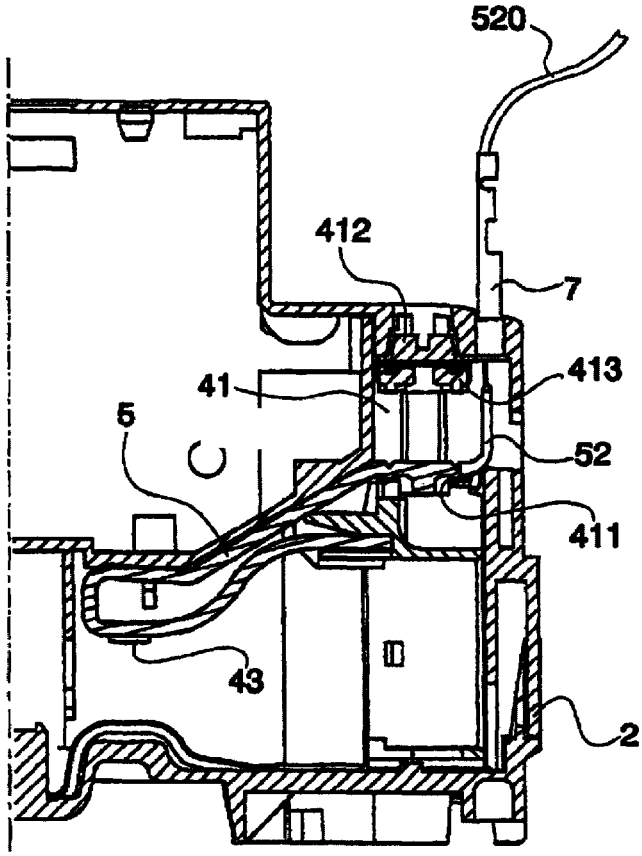
*Fig. 6*
*Fig. 7*
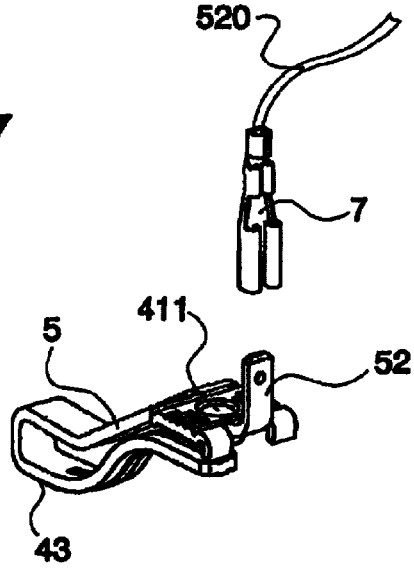

ELECTRICAL SWITCHGEAR

The present invention relates to switching devices such as contactors, motor protection switches, miniature circuit-breakers or circuit-breakers, or the like, as well as programmable switching devices, such as programmable logic controllers or programmable relays.

BACKGROUND

In conventional switching devices, such as contactors, each pole to be switched has a terminal contact in the form of a fixed contact on the input side and on the output side. To make or break the contact, the corresponding fixed contacts are closed or opened by a contact bridge, which is operated by an electromagnetic operating mechanism. In such devices, the externally accessible fixed contact terminals are usually formed by screw-type terminals which are accessible from the side and can be screwed down and released from the top side of the housing or by spring clamp terminals which are accessible from the side or from above and which can also be released from the side or from above.

Such a switching device having connection terminals of this type is already known from German Publication DE 201 20 504 U1. This switching device is equipped with screw-type terminals on one terminal side and with different connector elements, such as spring clamp terminals, on the other opposite terminal side.

Moreover, German Patent Application DE 100 23 851 A1 describes a connecting terminal for switching devices, where a standard screw connection can be replaced with a module for spring clamp connection.

SUMMARY OF THE INVENTION

The embodiments described above have been largely tried and tested in practice. It is, therefore, an object of the present invention to provide a switching device which is optimized in terms of the connection system. The intention is both to provide ease of use for the user and to improve the flexibility in terms of the variety of connection options.

Starting from an at least one-pole switching device where each pole has at least one incoming and one outgoing terminal contact, and each of the terminal contacts has first connection means for connection of a first external electrical conductor, the present invention provides at least one of the terminal contacts with second connection means for connection of a second electrical conductor. In a structurally and technically simple way, the switching device of the present invention is provided with both conventionally designed first connection means (such as screw clamp terminals or spring clamp terminals) and second connection means for additional connection elements, the first and second connection means being formed toward the outside of the housing.

The second connection means are located closer to the inside or closer to the outside of the switching device as compared to the first connection means.

In accordance with the present invention, the terminal contact carries a fixed contact leading to the interior of the housing (such as in contactors) or a connecting point for connection to internal electrical device conductors (such as in programmable logic controllers). The first connection means take the form of conventional screw clamp terminals, spring clamp terminals (such as cage clamp terminals), insulation-piercing terminals, or other connection means.

The additional second connection means take the form of means for frictionally and/or positively receiving a connection element, in particular in the form of a plug-in connector or a screw connector.

In one preferred embodiment, the second connection means are designed as central receiving holes for connection elements in the form of male contacts. To optimize the contacting of the second connection means, the hole-like opening, whether it is completely enclosed (receiving hole) or open on the edge (lateral cutout), is made as a punched rim hole, as a result of which tab-like extensions projecting toward the outside are formed around the edge of the opening, at least in some regions. In this manner, an additional connection option is provided for the externally accessible terminal contact in a structurally very simple manner. Other embodiments, such as a lateral cutout of the connection element or of the contact carrier, are also possible.

In another preferred embodiment, the second connection means take the form of male contacts. When the male contacts are disposed centrally, the first external electrical conductors can be easily inserted into the first connection means past the male contacts on the left, on the right, or on both sides thereof.

For access to the second connection means located inside the housing, the housing, which is made of insulating material, may optionally be provided with predetermined breaking points in an area above the second connection means; the predetermined breaking points defining an access area that can be broken open. The access area can also be designed to be initially open (uncovered).

BRIEF DESCRIPTION OF THE DRAWINGS

Further details and advantages of the present invention will become apparent from the exemplary embodiment described below with reference to the drawings, in which:

FIG. 6 is a partial longitudinal section through a multi-pole circuit-breaker having another type of second connection means;

FIG. 7 shows a detail from FIG. 6 in a perspective view.

DETALIED DESCRIPTION

Figure 1:
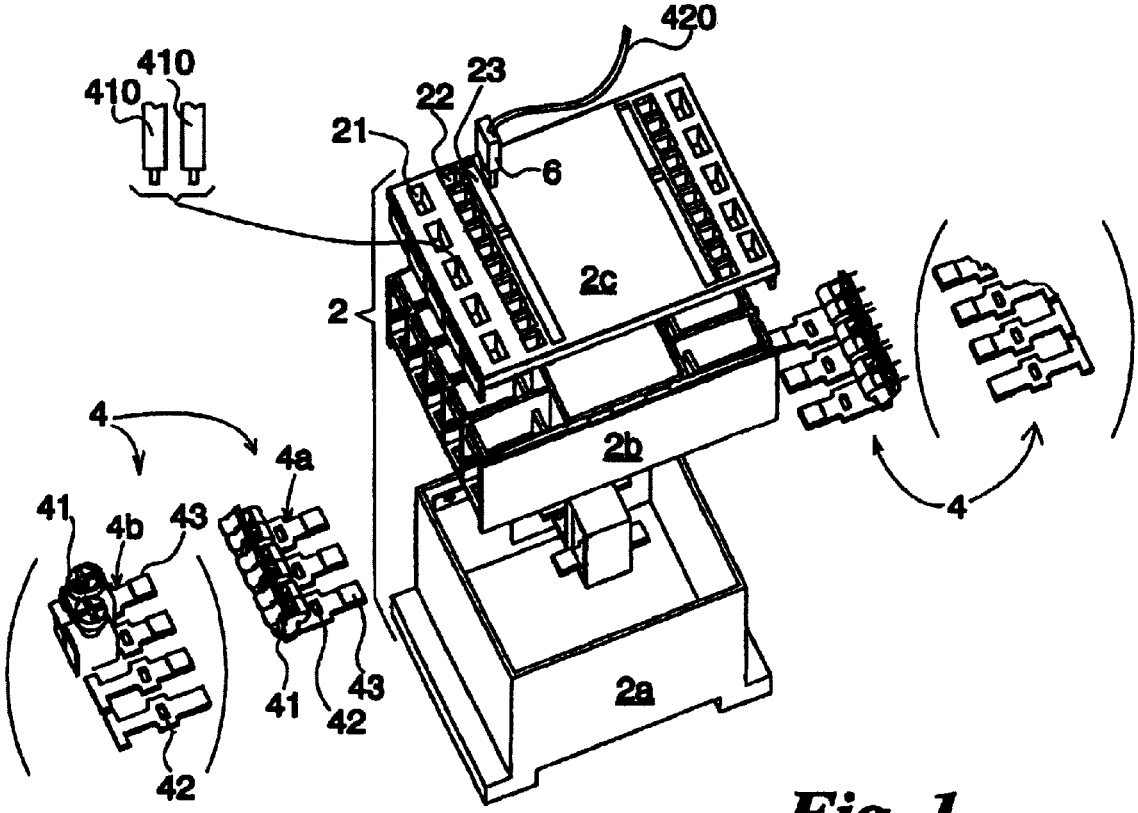
FIG. 1 is a schematic exploded view of a multi-pole contactor.

FIG. 1 is a schematic exploded view of the construction of a multi-pole contactor (which, in this case, has for example 3 or 4 poles as well as a supply connection for the operating coil of the electromagnetic operating mechanism), including a housing 2 made of insulating material; each pole having an incoming and one outgoing terminal contact 4.

In the present case, contactor housing 2 has a three-part design, including a base housing member 2*a* for accommodating an electromagnetic operating mechanism, an upper housing member 2*b* that can be placed on base housing member 2*a*, as well as a housing cover 2*c*. Moreover, terminal contacts 4 used for connection of incoming and outgoing leads are shown on both sides. Housing 2 may also be formed of two parts or just one part, depending on the type of switching device. Shown in brackets are connecting terminals 4*b* with screw clamp connection as alternative terminals for the connecting terminals 4*a* with spring clamp connection. In the present case, housing 2 shown is provided with connecting terminals 4*a* with spring clamp connection. In case that connecting terminals 4*b* with screw clamp connection are used, the existing cover member 2*c* must be replaced with one having suitable access openings for the screw heads instead of openings for the spring clamps. The cover member 2*c* shown is designed for connecting terminals 4*a* with spring clamp connection and has a first row of openings 21 for connection or access of first leads 410 to first connection means 41 of terminal contact 4*a*, a second row of (double) openings 22 for insertion of a tool (such as a screwdriver), as well as a third row of openings 23, or an opening in the form of a slotted opening, for connection of second leads 420 to additional second connection means 42 of terminal contact 4. In a preferred embodiment of the present invention, in the initial condition, the additional row of openings 23 (or the slotted opening) provided in accordance with the present invention is closed by a cover member. The cover member closing the opening may be reclosable via a snap connection or a film hinge. However, instead of being reclosable, it is preferred for opening 23 to be closed by one or a plurality of housing region(s) which is/are outlined by predetermined breaking points and can be broken away, and which form(s) the later access area to second connection means 42. This provides a particularly simple construction and avoids additional costs for warehousing and managing separate cover members.

The incoming and outgoing terminal contacts 4 shown are of two different, alternatives types. In a first embodiment, terminal contact 4*a* is formed with first connection means 41 in the form of spring clamp terminals, whereas in the alternative embodiment, screw clamp terminals are provided in place of the spring clamp terminals. In accordance with the present invention, both embodiments feature additional second connection means 42. A terminal contact 4 according to the present invention is preferably formed by a tongue-like terminal lug which, at the end facing toward the inside of the housing, is connected to electrical device conductors or, as in the present case, simply functions as a contact carrier carrying a fixed contact 43, and which, at the end facing toward the outside of the housing, is conventionally provided with first connection means 41 (such as screw clamp terminals or spring clamp terminals) and, in a region between these connecting points, is provided with second connection means 42, preferably in the form of a receiving hole. Preferably, second connection means 42 are spaced apart from first connection means 41 and designed to be independent in terms of their operation and connection method such that after wiring first connection means 41, on the one hand, the second connection means are freely accessible for further wiring and, on the other hand, it is not necessary to operate (release and re-secure) first connection means 41 for wiring second connection means 42.

Used for contacting second connection means 42 is, in particular, a connection element 6 in the form of a male contact. Using this connection element 6, the corresponding contactor contact can be freely wired in a conventional manner. In particular, it is also possible to prefabricate dimensionally stable, combined multi-contact male connectors, so that, for example, two adjacent contactors can be easily (pre-) wired as a reversing circuit or a star-delta circuit via the respective second connection means 42 using dimensionally stable rows of male contacts. Other applications, such as the combination of a motor protection switch with a contactor into a simple motor starter, can also be easily implemented in the case of remote devices to be wired, using prefabricated multi-contact male connectors which are connected by flexible, free wiring. Using the present invention, all these applications can be wired in a particularly simple manner without using the standard connecting point for this purpose. In the case of further wirings, it is therefore not necessary to release a connecting point which is already in use, insert additional conductors, and to re-secure the connecting point. This eliminates a frequent source of errors—there is no more need to release connections that are already functional or to slip additional conductors thereunder. Thus, when adding wiring at a later time, initially functional wired connections are prevented from becoming defective all of a sudden because an already wired conductor may have become detached. Moreover, the intention is to use the interface also for functional testing. The subject-matter of the present invention allows functional tests to be performed without removing the terminal wiring.

Figure 2B:
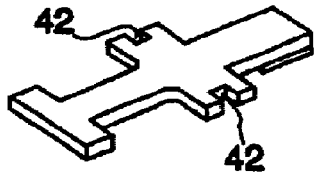
FIG. 2*b* shows an alternative embodiment of the second connection means.
Figure 2A:
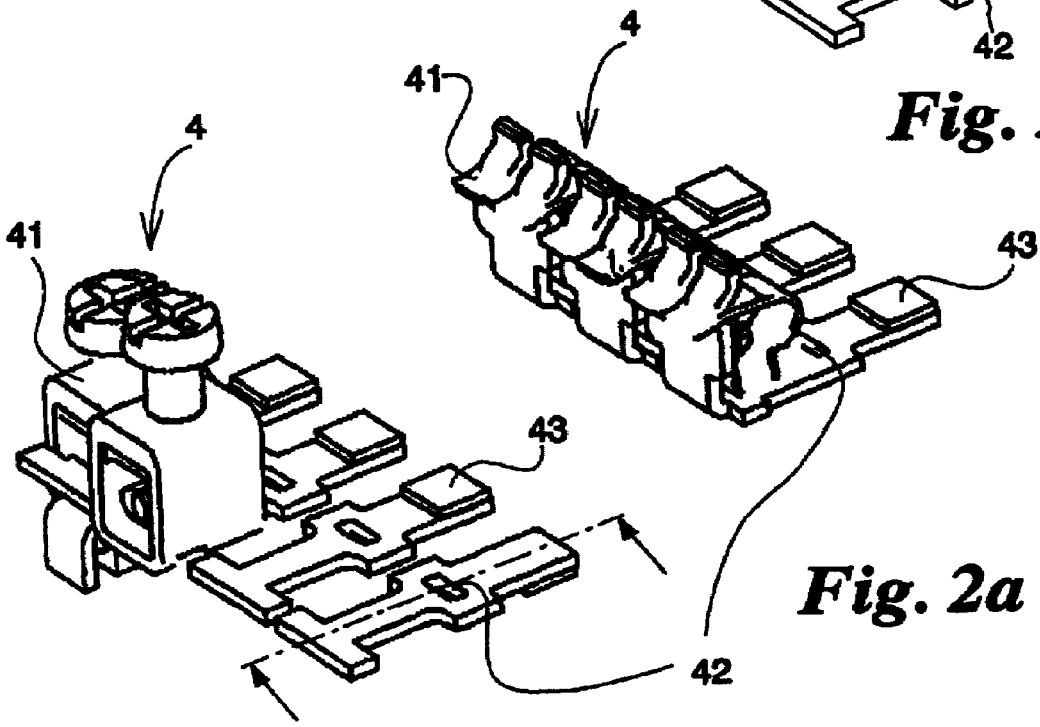
FIG. 2*a* depicts terminal contacts of the contactor with different first connection means (screw clamp and spring clamp terminals) as well as a possible embodiment of the second connection means (receiving hole) in accordance with FIG. 1.
Figure 4:
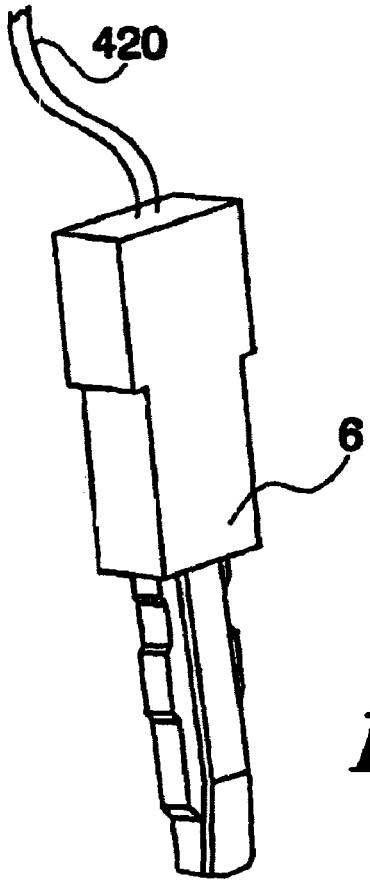
FIGS. 4 and 5 show possible embodiments of a male contact for the receiving hole according to FIG. 2*a;*
Figure 5:
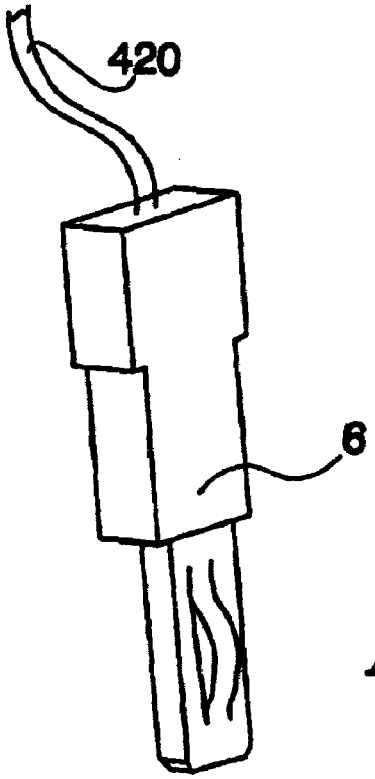

In FIG. 2*a*, the two alternative embodiments of terminal contacts 4 of the contactor previously shown in FIG. 1 are shown including different first connection means 41 (screw clamp and spring clamp terminals) and a possible embodiment of the second connection means 42 in the form of a receiving hole. Instead of the receiving hole, other contacting and connection options are also conceivable, such as one or a plurality of groove-type cutout(s) on the edge of terminal contact 4, or of the contact carrier (FIG. 2*b*). Male connectors particularly suitable for contacting the receiving hole or the cutout located on the edge are male connector types such as those shown in FIGS. 4 and 5. The male connector can advantageously be locked in the receiving hole either frictionally or both frictionally and positively. For this purpose, the male connector can be provided with resilient extensions projecting from its contact member which, in particular, has an oblong, rectangular parallelepiped shape (FIG. 5). It is also conceivable for the male contact to be circular in cross-section so that its contact member, which is also circular in cross-section, can be screwed into a correspondingly formed receiving hole. For that purpose, the receiving hole can already be threaded, or else the thread can be cut later by screwing-in the male contact.

Figure 3:
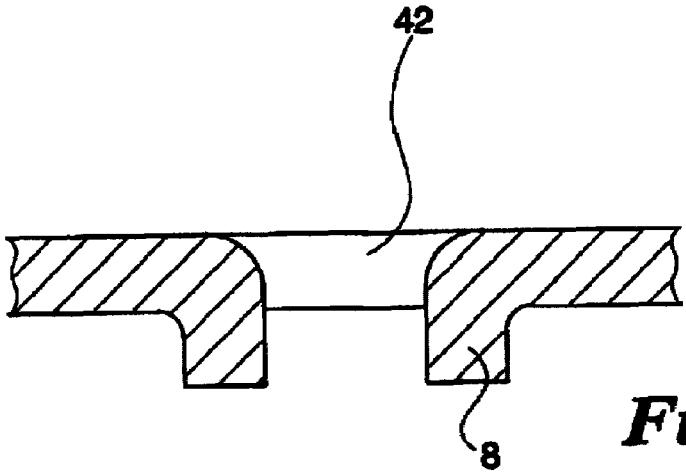
FIG. 3 is a detail view of the receiving hole according to FIG. 2.

FIG. 3 is an enlarged detail view of the receiving hole. The receiving hole is preferably formed as a punched rim hole such that contact tab sections (8) facing upward or downward are formed around the receiving hole, thereby enlarging the contact surface and optimizing the contacting.

FIG. 6 shows a section of a multi-pole circuit-breaker. Housing 2 accommodates one terminal contact 5 for each switch pole; the terminal contact being shown separately in FIG. 7. At the end facing toward the inside of the circuit-breaker, each terminal contact 5 carries a fixed contact 43 which cooperates with a corresponding contact bridge (not shown). At the outward end, terminal contact 5 is provided with a first connection means 41 in the form of clamp-type terminal. First connection means 41 has a clamping screw 412 carried in a threaded hole 411 of terminal contact 5 and a clamping washer 413 supported on the clamping screw. First connection means 41 allows connection of at least one first external electrical conductor. On the other side of the threaded hole 411, i.e., closer to the outside of the circuit-breaker, terminal contact 5 ends in a second connection means 52 which is bent at a right angle to the front face and takes the form of a flat male contact. A female connector 7 in the form of a flat push-on sleeve can be frictionally and positively plugged onto this second connection means 52. Female connector 7 is securely connected to one end of a second external conductor 520. Second connection means 52 is disposed centrally with respect to the terminal contact, i.e., it is in alignment with the longitudinal axis of clamping screw 412. Moreover, second connection means 52 has a width small enough to allow first external conductors to be easily inserted into the clamping space of first connection means 41 on both sides of the second connection means. In this manner, advantageously, forked connector elements, such as are used, in particular, in three-phase commoning links, can also be inserted into the clamping space.

What is claimed is:

1. An electrical switching device having at least one pole, the electrical switching device comprising:

a housing including an insulating material; and an incoming terminal contact and an outgoing terminal contact associated with a first pole, each of the terminal contacts including a respective first connection device configured for connection of a respective first external electrical conductor and a respective fixed contact, at least one of the terminal contacts including a respective second connection device disposed inside the housing and configured for pluggable connection of a respective second electrical conductor between the respective first connection device and the fixed contact, wherein the respective second connection device includes at least one of a receiving hole and a lateral cutout configured to receive a respective male contact connected to the respective second electrical conductor.

2. The electrical switching device as recited in claim 1 wherein:

each of the terminal contacts includes a respective contact carrier, a respective connecting point for housing-internal contacting, the respective connecting point and the respective fixed contact being disposed at a first end of the respective contact carrier, the respective first connection device being disposed at a second end of the respective contact carrier; and the respective second connection device is disposed between the respective connecting point and the respective first connection device.

3. The electrical switching device as recited in claim 2 wherein the respective connecting point includes at least one of the respective fixed contact and a connecting point for wiring.

4. The electrical switching device as recited in claim 1 wherein the respective first connection device includes at least one of a screw clamp terminal, a spring clamp terminal, and an insulation-piercing terminal.

5. The electrical switching device as recited in claim 1 wherein the respective second connection device is configured to at least one of frictionally and positively receive a respective connection element.

6. The electrical switching device as recited in claim 1 wherein the respective second connection device includes the receiving hole, the receiving hole having a contact tab section extending upward or downward at an edge portion thereof.

7. The electrical switching device as recited in claim 1 wherein the housing includes an access area configured to provide access to the respective second connection device, the access area being outlined by predetermined breaking points.

8. The electrical switching device as recited in claim 1 further comprising a second incoming terminal contact and a second outgoing terminal contact associated with a second pole, each of the second terminal contacts including a respective third connection device configured for connection of a respective third external electrical conductor, at least one of the second terminal contacts including a respective fourth connection device configured for pluggable connection of a respective fourth electrical conductor.

9. An electrical switching device having at least one pole, the electrical switching device comprising:

a housing including an insulating material; and an incoming terminal contact and an outgoing terminal contact associated with a first pole, each of the terminal contacts including a respective first connection device configured for connection of a respective first external electrical conductor and a respective fixed contact, at least one of the terminal contacts including a respective second connection device disposed inside the housing and configured for pluggable connection of a respective second electrical conductor between the respective first connection device and the respective fixed contact, wherein the respective first connection device includes at least one of a screw clamp terminal, a spring clamp terminal, and an insulation-piercing terminal.

10. An electrical switching device having at least one pole, the electrical switching device comprising:

a housing including an insulating material; and an incoming terminal contact and an outgoing terminal contact associated with a first pole, each of the terminal contacts including a respective first connection device disposed inside the housing and configured for connection of a respective first external electrical conductor, at least one of the terminal contacts including a respective second connection device disposed inside the housing and configured for pluggable connection of a respective second electrical conductor, wherein the respective second connection device includes at least one of a receiving hole and a lateral cutout configured to receive a respective male contact connected to the respective second electrical conductor;

wherein each of the terminal contacts includes a respective contact carrier, a respective connecting point for housing-internal contacting being disposed at a first end of the respective contact carrier, the respective first connection device being disposed at a second end of the respective contact carrier; and wherein the respective second connection device is disposed between the respective connecting point and the respective first connection device.

11. The electrical switching device as recited in claim 10 wherein the respective connecting point includes at least one of a fixed contact of a switching contact and a connecting point for wiring.

12. An electrical switching device having at least one pole, the electrical switching device comprising:

a housing including an insulating material; and an incoming terminal contact and an outgoing terminal contact associated with a first pole, each of the terminal contacts including a respective first connection device disposed inside the housing and configured for connection of a respective first external electrical conductor, at least one of the terminal contacts including a respective second connection device disposed inside the housing and configured for pluggable connection of a respective second electrical conductor, wherein the respective second connection device includes at least one of a receiving hole and a lateral cutout configured to receive a respective male contact connected to the respective second electrical conductor;

wherein the housing includes an access area configured to provide access to the respective second connection device, the access area being outlined by predetermined breaking points.

* * * * *